US007717753B2

(12) United States Patent
Chen

(10) Patent No.: US 7,717,753 B2
(45) Date of Patent: May 18, 2010

(54) ELECTRICAL CONNECTOR WITH A SLEEVE THEREIN

(75) Inventor: Zhi-Qiang Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,106

(22) Filed: Apr. 28, 2009

(65) Prior Publication Data

US 2009/0269982 A1 Oct. 29, 2009

(30) Foreign Application Priority Data

Apr. 28, 2008 (CN) ..... 2008 2 0300644 U

(51) Int. Cl.
*H01R 24/04* (2006.01)

(52) U.S. Cl. ..... 439/668; 439/607.01

(58) Field of Classification Search ..... 439/668, 439/607.01, 669, 607.35
See application file for complete search history.

(56) References Cited

U.S. PATENT DOCUMENTS 6,551,127 B1 4/2003 Li et al.
7,530,813 B1 * 5/2009 Tsai et al. ..... 439/63
2008/0076303 A1 * 3/2008 Zhang ..... 439/668

* cited by examiner

*Primary Examiner*—Gary F. Paumen
(74) *Attorney, Agent, or Firm*—Andrew C. Cheng; Wei Te Chung; Ming Chieh Chang

(57) ABSTRACT

An electrical connector includes an insulating housing (1) defining a receiving cavity (10) with an opening (101) opened forward and running through a mating face (11). A plurality of terminals are mounted in the insulating housing. A cover (4) defines a space for partly receiving the insulating housing therein, and includes a front wall (43) with an aperture (430) corresponding with the opening (101). A shell (5) is provided for shielding the insulating housing and the cover. A sleeve (3) has a base portion (32) sandwiched between the mating face (11) and the front wall (43) of the cover (4), and a ring (31) projecting forward through the aperture (430), therefore the sleeve can not release from the insulating housing easily.

13 Claims, 6 Drawing Sheets

ELECTRICAL CONNECTOR WITH A SLEEVE THEREIN

BACKGROUND OF THE INVENTION

1. Field of the Invention

The present invention relates to an electrical connector, and particularly to an electrical connector with a ring assembled therein.

2. Description of the Related Art

U.S. Pat. No. 6,551,127 issued to Li et al. on Apr. 22, 2003 discloses an electrical connector for signal transmission. The electrical connector includes a housing mounted with a plurality of terminals and forming a cylindraceous mating portion protruding forward from the housing for receiving a mating plug therein. The electrical connector further comprises an insulating sleeve assembled in an inner side of the mating portion and locked with the mating portion by a pair of hooks buckling with an end of the mating portion and a plurality of ribs interfering with the inner side of the mating portion. However, the sleeve may release from the mating portion after multiple usage of the mating plug. Hence, an electrical connector which can solve the problem is needed.

SUMMARY OF THE INVENTION

Accordingly, an object of the present invention is to provide an electrical connector for steadily fastening a sleeve therein.

In order to achieve the object set forth, an electrical connector includes an insulating housing defining a receiving cavity with an opening opened forward and running through a mating face. A plurality of terminals are mounted in the insulating housing. A cover defines a space for partly receiving the insulating housing therein and has a front wall with an aperture corresponding with the opening. A sleeve has a base portion sandwiched between the mating face and front wall of the cover, and a ring projecting forward through the aperture. A shell is provided for shielding the insulating housing and cover.

Other objects, advantages and novel features of the invention will become more apparent from the following detailed description of the present embodiment when taken in conjunction with the accompanying drawings.

DETAILED DESCRIPTION OF THE INVENTION

Figure 1:
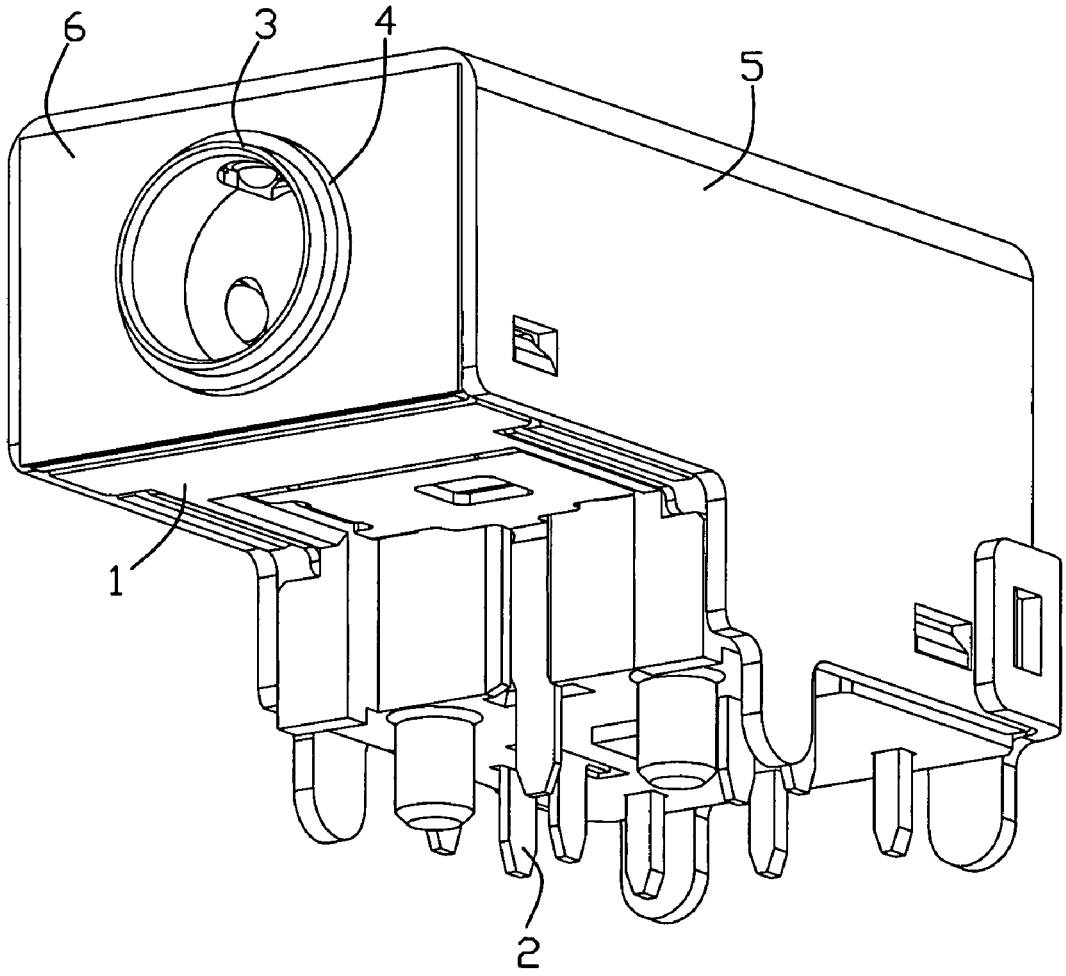
FIG. 1 is a perspective view of an electrical connector in accordance with the present invention.
Figure 3:
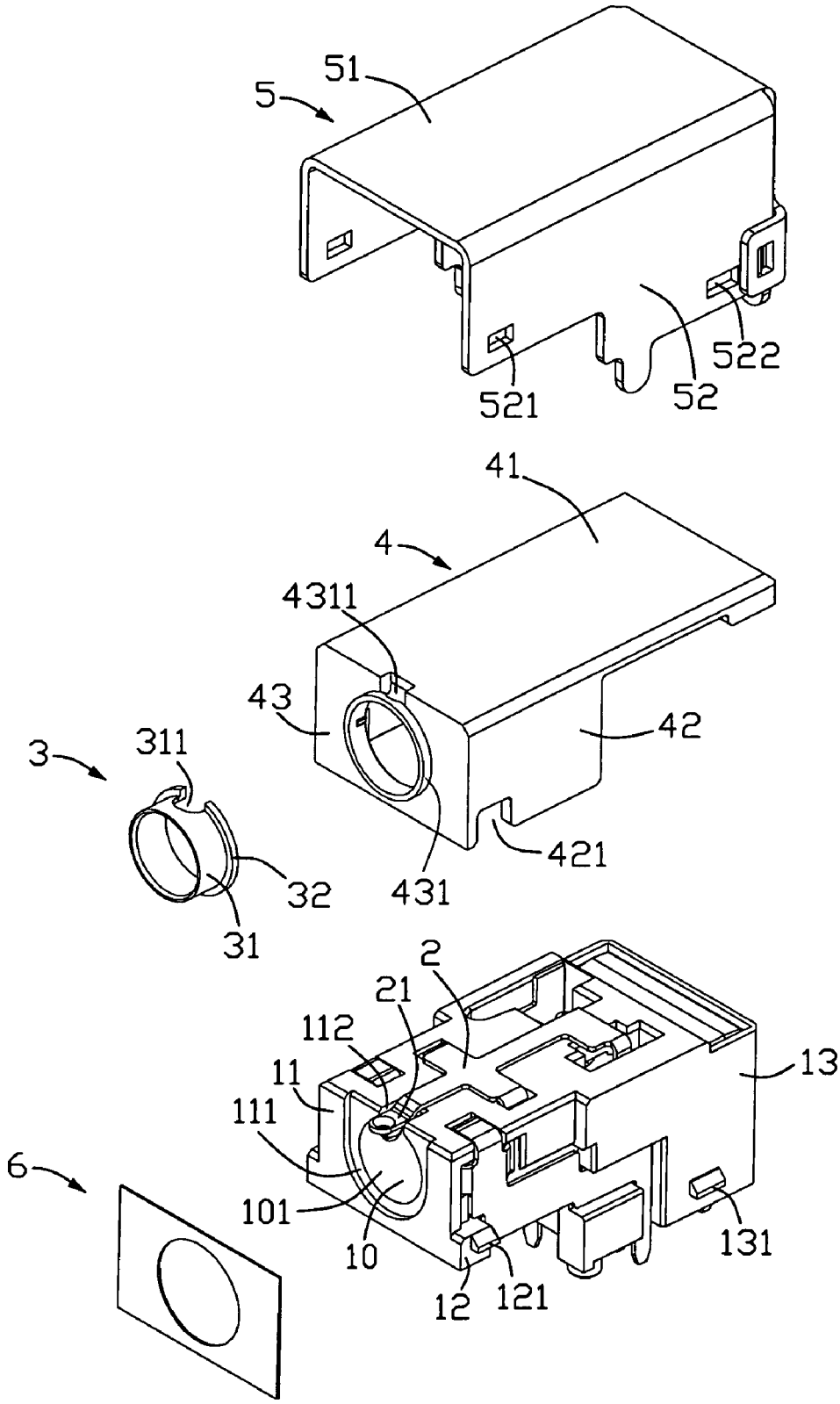
FIG. 3 is an exploded view of the electrical connector shown in FIG. 1.

Reference will now be made to the drawing figures to describe a preferred embodiment of the present invention in detail. Referring to FIGS. 1 and 3, an electrical connector 100 according to the preferred embodiment of the present invention is provided and comprises an insulating housing 1, a plurality of terminals 2 mounted in the housing 1, a sleeve 3 mounted in the housing 1, a cover 4 fastening the sleeve 3 and mounted on the housing 1, a shell 5 surrounding the housing 1 and the cover 4, and a flake 6 attached to a mating face 11 of the housing 1.

The insulating housing 1 defines a receiving cavity 10 running through the mating face 11 thereby defining an opening 101 for guiding a mating plug to be inserted. A recess portion 111 is defined around the opening 101 and recessed rearward, with a gap 112 defined at an upper portion of the housing and communicating with the receiving cavity 10. A grounding terminal 2 is fixed in an upper wall of the housing and includes a contacting portion 21 projecting into the receiving cavity through the gap 112. Each side wall of the insulating housing 1 is in a step configuration and comprises a first side wall 12 at a front end thereof and a second side wall 13 at a rear end and protruding outward. Each first and second side walls 12, 13 form a protrusion portion 121, 131 protruding outward for locking with the shell 5.

The metallic sleeve 3 includes an annular base portion 32 and a ring 31 extending forward from the base portion 32, wherein the ring is in a smaller dimension than the base portion 32. A hole 311 is defined on the sleeve 3 corresponding with the gap 112 on the insulating housing 1.

Figure 4:
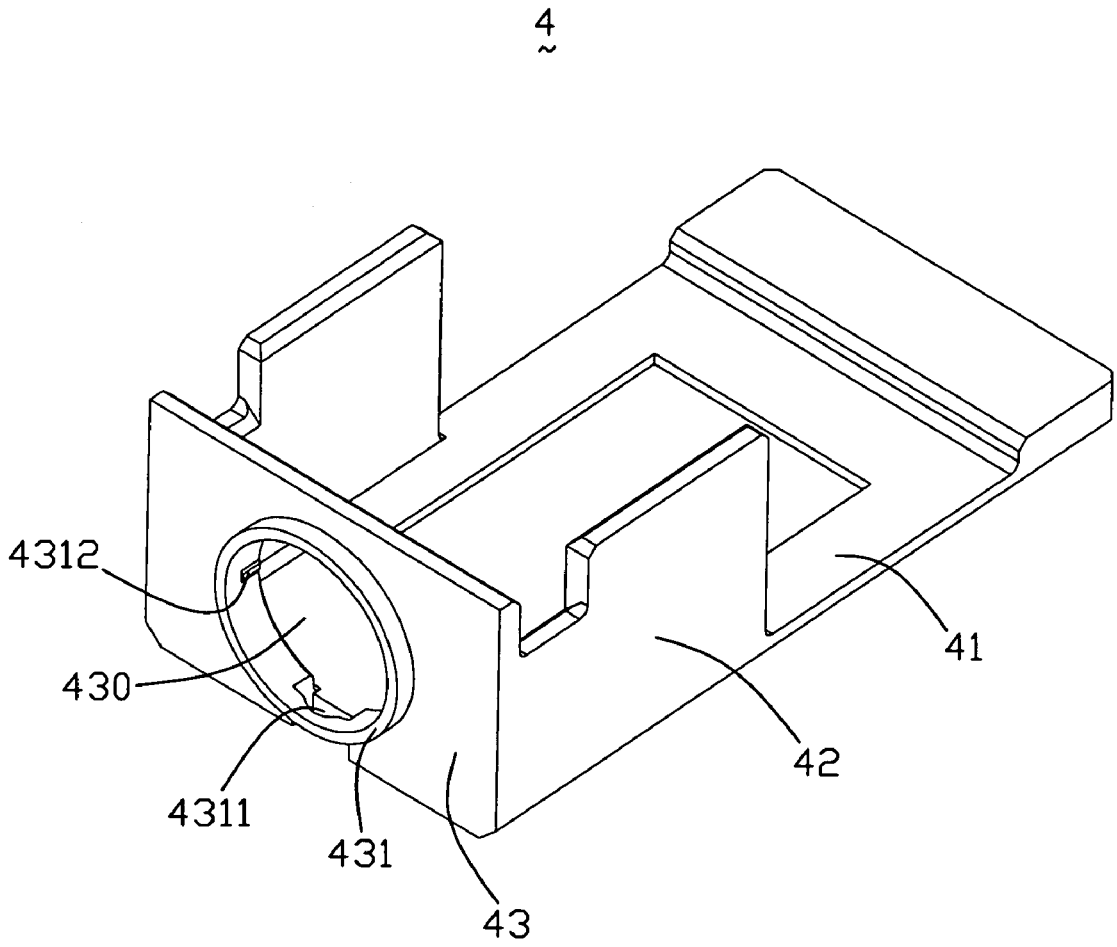
FIG. 4 is a perspective view of a cover of the electrical connector shown in FIG. 1.

Referring to FIGS. 3 and 4, the cover 4 includes a rectangular body portion 41, a pair of side wall 42 extending downward from opposite side edges of the body portion 41, a front wall 43 extending downward from a front edge of the body portion 41 and connecting with the side wall 42, thereby defining a space surrounded by the three walls. An aperture 430 is defined on the front wall 43 for receiving the sleeve 3 and in communication with the space, and an annular extending portion 431 projecting forward from circumference of the aperture 430. A slot 4311 corresponding with the hole 311 is defined at a joint portion of the body portion 41 and front wall 43. A plurality of ribs 4312 are provided in an inner side wall of the extending portion 431 for improving the interfering force.

Figure 5:
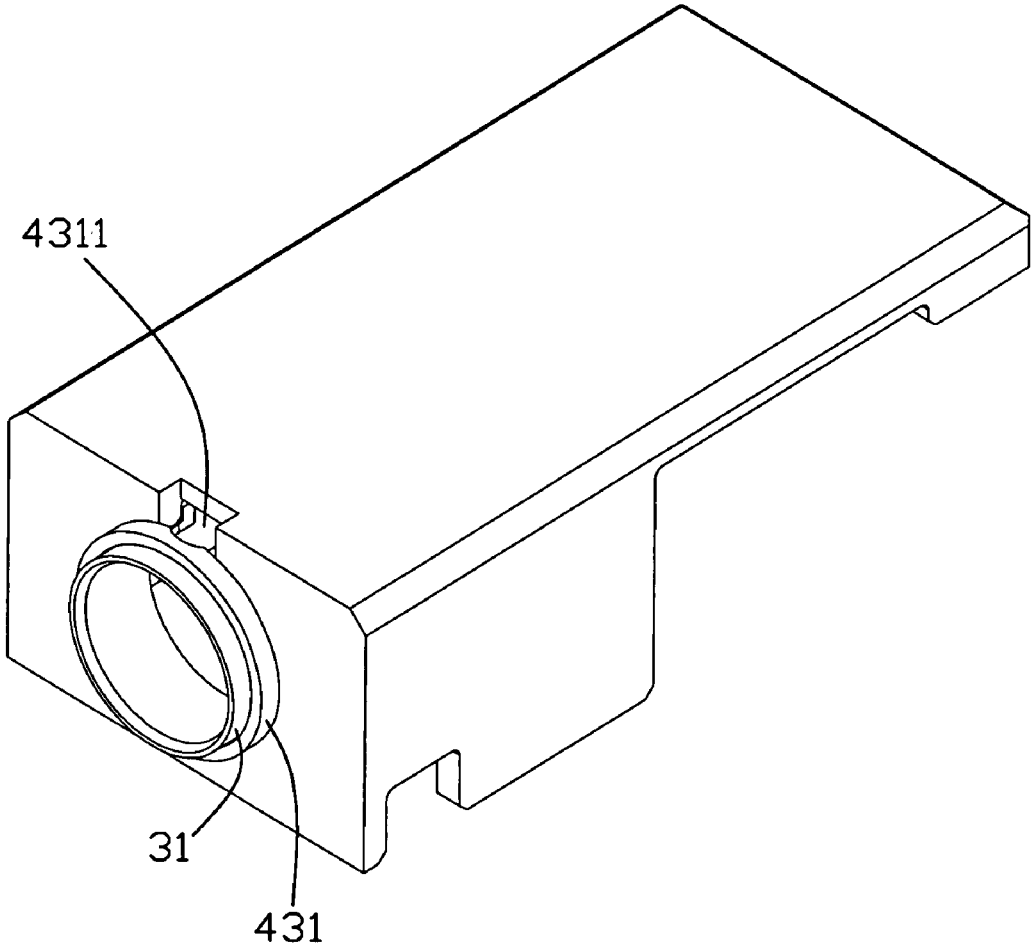
FIG. 5 is a perspective view of the cover with a sleeve mounted therein.
Figure 6:
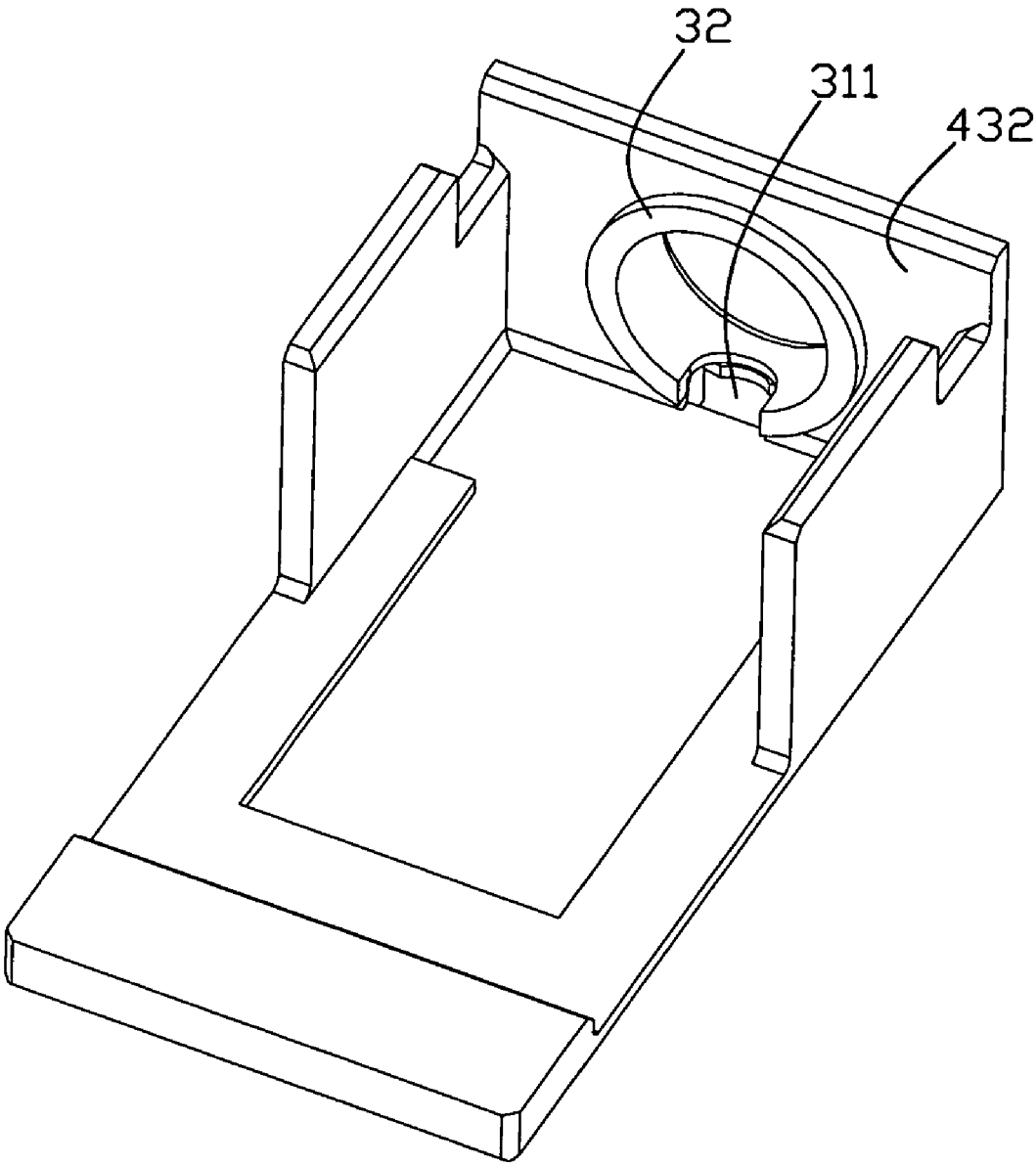
FIG. 6 is another perspective view of the cover with the sleeve mounted therein.

Referring to FIGS. 5 and 6, the sleeve 3 is inserted into the cover 4 from a rear end, the ring 31 of the sleeve 3 projects forward and exposes to an exterior of the extending portion 431 by running through the aperture 430, meanwhile, circumference of the ring 31 is interfering with the ribs 4312 on the extending portion 431 for retention, and the base portion 32 is blocked by a rear end of the extending portion 431 (i.e. an inner face 432 of the front wall 43) for preventing the forward movement of the sleeve 3. The slot 4311 on the extending portion 431 is aligned with the hole 311 on the ring 31 at this time, therefore, the sleeve 3 is primarily mounted on the cover 4.

Figure 2:
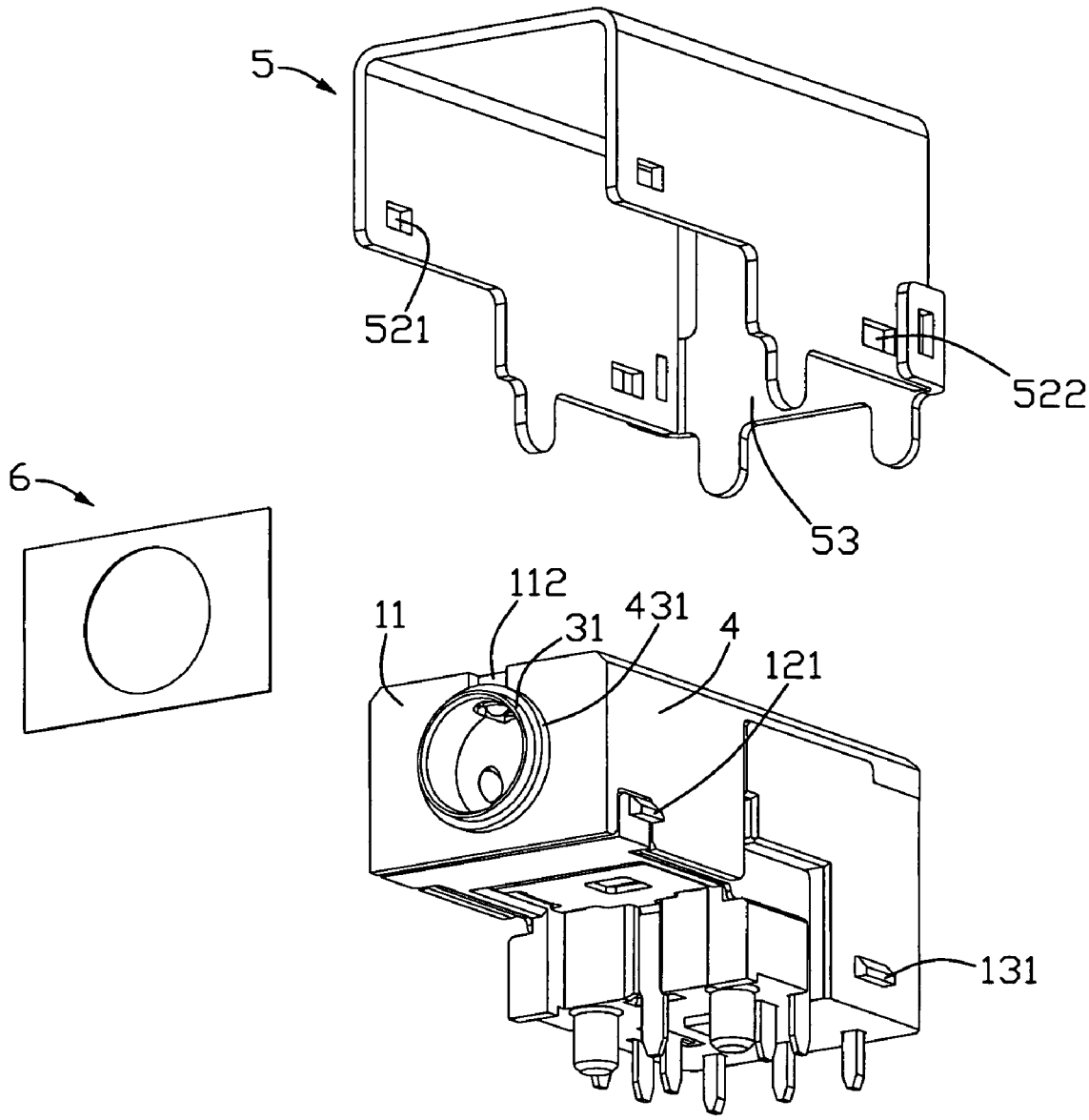
FIG. 2 is a partly exploded view of the electrical connector shown in FIG. 1.

Referring to FIGS. 2 and 3, the cover 4 together with the sleeve 3 is assembled onto the insulating housing 1. The side walls 42 of the cover 4 are tightly affixed to the first walls 12 with rear ends abutting against front ends of the second walls 13, and the protrusion portions 121, 131 of the first and second walls 12, 13 are received in apertures 421 defined at lower ends of the side walls 42. The front wall 43 is tightly affixed to the mating face 11 of the housing 1 with the base portion 32 received in the recess portion 111 and the contacting portion 21 of the contact 2 projecting into the hole 311 on the sleeve and slot 4311 on the extending portion. The body portion 41 covers the upper wall of the housing 1 and sandwiches the terminal 2 together with the upper wall of the housing. Under this condition, the sleeve 3 is finally retained between the cover 4 and the insulating housing 1, and can not move toward any direction. Then, the shell 5 is assembled onto the housing 1 with a top wall 51 covering the base portion 41 of the cover 4, locking holes 521, 522 defined on each side wall 52 being locked with corresponding protrusion portions 121, 131, and a rear wall 53 shielding the rear ends of the housing 1 and cover 4. Finally, the flake 6 is attached onto the front wall 43 of the cover 4 for beautiful looking, therefore, an integral electrical connector has been made with steadily retention effect.

In the present invention, the sleeve 3 is primarily assembled onto a cover 4 and then assembled onto the housing 1 so that the sleeve 3 is sandwiched between the housing 1 and the cover 4 and can not release from the housing easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a receiving cavity with an opening opened forward and running through a mating face thereof;

a plurality of terminals mounted in the insulating housing;

a cover defining a space for partly receiving the insulating housing therein, and having a front wall with an aperture corresponding with the opening;

a sleeve having a base portion sandwiched between the mating face and the front wall of the cover, and a ring projecting forward through the aperture; and a shell shielding the insulating housing and the cover.

2. The electrical connector as described in claim 1, wherein a recess portion is defined at circumference of the opening for receiving the base portion of the sleeve therein.

3. The electrical connector as described in claim 2, wherein at least one terminal has a contacting portion projecting into the receiving cavity through a gap defined at the recess portion, and the cover and the sleeve respectively define a slot and a hole corresponding with the gap for accommodating the contacting portion.

4. The electrical connector as described in claim 1, wherein a forward movement of the base portion of the sleeve is prevented by the front wall.

5. The electrical connector as described in claim 4, wherein the front wall of the cover defines an extending portion projecting forward from the aperture and forms a plurality of ribs in an inner side thereof for interfering with the ring of the sleeve.

6. The electrical connector as described in claim 1, wherein the insulating housing comprises side walls connecting with the mating face, each side wall includes a first wall and a second wall projecting outwardly relative to the first wall, and the cover comprises opposite walls affixed to the first wall of the insulating housing.

7. The electrical connector as described in claim 6, wherein the shell includes side walls with locking holes thereon for being locked with protrusion portions formed on the first and second walls, and a rear wall shielding rear ends of the insulating housing and the cover.

8. An electrical connector comprising:

a stacked housing including an insulating housing and a cover riding on the insulating housing, the insulating housing defining a receiving space opened forward and running through a mating face of the insulating housing and a front wall of the cover;

a plurality of terminals mounted on the insulating housing;

a sleeve sandwiched between the mating face of the insulating housing and the front wall of the cover, and partly exposed to an exterior of the front wall of the cover; and a shell tightly combining the insulating housing and the cover together.

9. The electrical connector as described in claim 8, wherein the insulating housing comprises side walls connecting with the mating face, each side wall includes a first wall and a second wall projecting outwardly relative to the first wall, the cover comprises opposite walls being affixed to the first wall of the insulating housing.

10. The electrical connector as described in claim 9, wherein the cover includes a body portion connecting with the front wall and the opposite walls thereby defining a space for receiving a front portion of the insulating housing.

11. An electrical connector comprising:

an insulative housing defining a front wall with a first front opening extending therethrough in a front-to-back direction;

a conductive terminal positioned upon one face of the housing with a contact section extending inwardly around a circumference of said first front opening;

a metallic sleeve located in front of and in alignment with the first front opening, wherein said sleeve defines a notch to allow said contact section to be located therein; and an insulative cover defining a front face, which covers the front wall, with a second front opening receiving said sleeve;

said cover defines in a front-to-back direction a slot to allow outward movement of the contact section.

12. The electrical connector as claimed in claim 11, wherein the sleeve defines a circumferential flange received in a recess in the front wall, and the front face defines another circumference flange to be received in a third front opening formed in a metallic plate attached upon the front face of the cover.

13. The electrical connector as claimed in claim 12, wherein said sleeve is sandwiched between the cover and the housing not only axially but also radially.

* * * * *